US008042756B2

(12) United States Patent
Dallimore et al.

(10) Patent No.: US 8,042,756 B2
(45) Date of Patent: Oct. 25, 2011

(54) VERTICAL SHAFT IMPACT CRUSHER

(75) Inventors: Rowan Dallimore, Bath (GB); George Fensome, Bristol (GB); Knut Kjaerran, Svedala (SE)

(73) Assignee: Sandvik Intellectual Property AB, Sandviken (SE)

( * ) Notice: Subject to any disclaimer, the term of this patent is extended or adjusted under 35 U.S.C. 154(b) by 1 day.

(21) Appl. No.: 12/588,190

(22) Filed: Oct. 7, 2009

(65) Prior Publication Data

US 2010/0090045 A1 Apr. 15, 2010

(30) Foreign Application Priority Data

Oct. 9, 2008 (SE) ..... 0802127

(51) Int. Cl.
*B02C 19/00* (2006.01)

(52) U.S. Cl. ..... 241/275; 241/285.3

(58) Field of Classification Search ..... 241/275, 241/285.2, 285.3; 29/402.08
See application file for complete search history.

(56) References Cited

U.S. PATENT DOCUMENTS

| | | | | |
|---|---|---|---|---|
| 4,098,466 | A | 7/1978 | MacElvain et al. | |
| 4,151,959 | A | 5/1979 | Deister | |
| 4,923,131 | A * | 5/1990 | Rossouw et al. | 241/275 |
| 5,083,714 | A | 1/1992 | Vendelin et al. | |

FOREIGN PATENT DOCUMENTS

WO WO 2004/020103 3/2004

* cited by examiner

*Primary Examiner* — Mark Rosenbaum
(74) *Attorney, Agent, or Firm* — Drinker Biddle & Reath LLP

(57) ABSTRACT

A vertical shaft impact crusher includes a rotor that rotates about a substantially vertical axis for accelerating a flow of material to be crushed. The crusher further includes a housing, a feed tube, and a feeding chamber. The housing includes a circumferential impact wall section against which the accelerated flow of material may be crushed. The feed tube is for vertically feeding a flow of material into the rotor to be crushed. The feeding chamber includes a feeding chamber side wall and is for vertically feeding a flow of material into the feed tube. A first door is provided for opening and closing an aperture in the feeding chamber side wall. The feed tube is removable from the feeding chamber via the first aperture.

9 Claims, 5 Drawing Sheets

VERTICAL SHAFT IMPACT CRUSHER

CROSS REFERENCE TO RELATED APPLICATIONS

This application claims priority from Swedish patent application No. 0802127-1, filed on Oct. 9, 2008, the subject matter of which is incorporated herein by reference.

TECHNICAL FIELD

The present disclosure relates to a vertical shaft impact crusher including a rotor that rotates about a substantially vertical axis for accelerating a flow of material to be crushed. The crusher further includes a housing, a feed tube, and a feeding chamber with an aperture and door at least on a feeding chamber side wall that enables the removal of a feed tube via the aperture.

The disclosure also relates to a feeding chamber side wall, and to a method for replacing a worn feed tube of a vertical shaft impact crusher.

BACKGROUND

Vertical shaft impact crushers (VSI-crushers) are used in many applications for crushing hard material like rocks, ore, etc. WO 2004/020103 describes a VSI-crusher comprising a housing and a horizontal rotor located inside the housing. Material that is to be crushed is fed vertically into the rotor via a hopper, a feeding chamber and a feed tube. With the aid of centrifugal force the rotating rotor ejects the material against the wall of the housing, and on impact with the wall the material is crushed to a desired size.

Replacement of the feed tube, which is a wear part, is an expensive, complicated, and time consuming operation, typically involving lifting an upper portion of the crusher, including the hopper, with a crane.

SUMMARY

Simplifying the replacement of a feed tube could improve the continuous use of a vertical shaft impact crusher.

An exemplary vertical shaft impact crusher comprises a rotor that rotates about a substantially vertical axis for accelerating a flow of material to be crushed; a housing comprising a circumferential impact wall section against which the accelerated flow of material may be crushed; a feed tube for vertically feeding a flow of material into the rotor to be crushed; a feeding chamber for vertically feeding a flow of material into the feed tube, wherein the feeding chamber includes a feeding chamber side wall; and a first door for opening and closing a first aperture in the feeding chamber side wall, wherein said feed tube is removable from said feeding chamber via said first aperture.

In a crusher of the above type, the feed tube may be replaced via the first aperture. This allows for a much simpler replacement procedure, without the need for removing a hopper or any other structure mounted above the feeding chamber.

In a specific embodiment the first aperture has a width that is larger than a width of the feed tube. An advantage of this embodiment is that it requires little effort to remove, and insert, a feed tube via the first aperture.

In another specific embodiment, the feeding chamber side wall is cylindrical with a circular shape, when viewed along the vertical axis, and the first door has a profile, when viewed along the vertical axis, that is curved along the circular shape of the feeding chamber side wall. Thanks to the curved profile of the door, the symmetry of the feeding chamber side wall is maintained, thereby the wear on the feeding chamber side wall is uniform.

In yet another specific embodiment, the feeding chamber side wall has a polygonal shape, when viewed along the vertical axis. This embodiment makes the design and fabrication of a door with a good fit less expensive, since it can be made flat.

In one embodiment, the crusher comprises a second door for opening and closing a second aperture formed in the housing, wherein the second aperture is at least partially aligned with the first aperture, such that the feed tube may be removed from the feeding chamber via the first aperture and further from the housing via the second aperture. In a further embodiment, the second aperture has a width that is larger than the width of the feed tube. This further embodiment is particularly well suited for crushers on which the housing extends up around the feeding cylinder, since taking out a worn feed tube from the crusher, and inserting a new feed tube into the crusher, is facilitated. This is the case in, e.g., VSI-crushers allowing several flows of material to be crushed, in line with the teachings of WO 2004/020103.

Should the crusher also comprise a feed tube retaining plate for holding the feed tube in position above the rotor, the width W1 of the first aperture can be larger than a width W4 of the feed tube retaining plate. This is particularly useful, as in many VSI-crushers comprising a feed tube retaining plate, because the retaining plate also is a wear part requiring occasional replacement.

An exemplary feeding chamber side wall, for a vertical shaft impact crusher that includes a rotor that rotates about a substantially vertical axis for accelerating a flow of material to be crushed, comprises a first aperture in the feeding chamber side wall configured to allow a feed tube of the vertical shaft impact crusher to be removed from said feeding chamber; and a first door for opening and closing the first aperture.

A feeding chamber side wall of this type may be used to replace the feeding chamber side wall of a crusher having a conventional feeding chamber side wall without the aperture and the door. In this manner, by replacing the feeding chamber side wall of an old crusher with a feeding chamber side wall according to one of the embodiments of the disclosure, future replacements of the feed tube will be facilitated. After installing one of the feeding chamber side walls according to the embodiments of the disclosure, the feed tube may be replaced via a first aperture. This allows for a much more simple replacement procedure.

In a specific embodiment, the first aperture has a width that is larger than 10% of the circumference of the feeding chamber side wall, when viewed along the vertical axis. An advantage of this embodiment is that a first aperture of suitable size for removing, or inserting, a feed tube via the first aperture is achieved.

In another specific embodiment, the feeding chamber side wall is cylindrical with a circular shape, when viewed along the vertical axis, and the first door has a profile, when viewed along the vertical axis, that is curved along the circular shape of the feeding chamber side wall. In yet another specific embodiment, the feeding chamber side wall has a polygonal shape, when viewed along the vertical axis.

An exemplary method for replacing a worn feed tube of a vertical shaft impact crusher, the crusher comprising a rotor that rotates about a substantially vertical axis for accelerating a flow of material to be crushed; a housing comprising a circumferential impact wall section against which the accelerated flow of material may be crushed; a feed tube for vertically feeding a flow of material into the rotor to be crushed; a feeding chamber for vertically feeding a flow of material into the feed tube, wherein the feeding chamber includes a feeding chamber side wall; and a first door for opening and closing a first aperture in the feeding chamber side wall, comprises the steps of: uncovering the first aperture in the feeding chamber side wall by operating the first door; removing the worn feed tube via the first aperture; installing a new feed tube via the first aperture; and closing the first door.

In an embodiment particularly well suited for crushers on which the housing extends up around the feeding cylinder, the method comprises uncovering, prior to uncovering the first aperture in the feeding chamber side wall, a second aperture in the housing by operating a second door in the housing; removing the worn feed tube via the first aperture and the second aperture; inserting the new feed tube via the second aperture and the first aperture; and closing, after closing the first door, the second door. Further, the second aperture may be at least partially aligned with the first aperture to allow a feed tube to pass through the first aperture and the second aperture.

Further objects and features of the present invention will be apparent from the description and the claims.

BRIEF DESCRIPTION OF THE DRAWINGS

The invention will hereafter be described in more detail and with reference to the appended drawings.

DETAILED DESCRIPTION OF PREFERRED EMBODIMENTS

Figure 1:
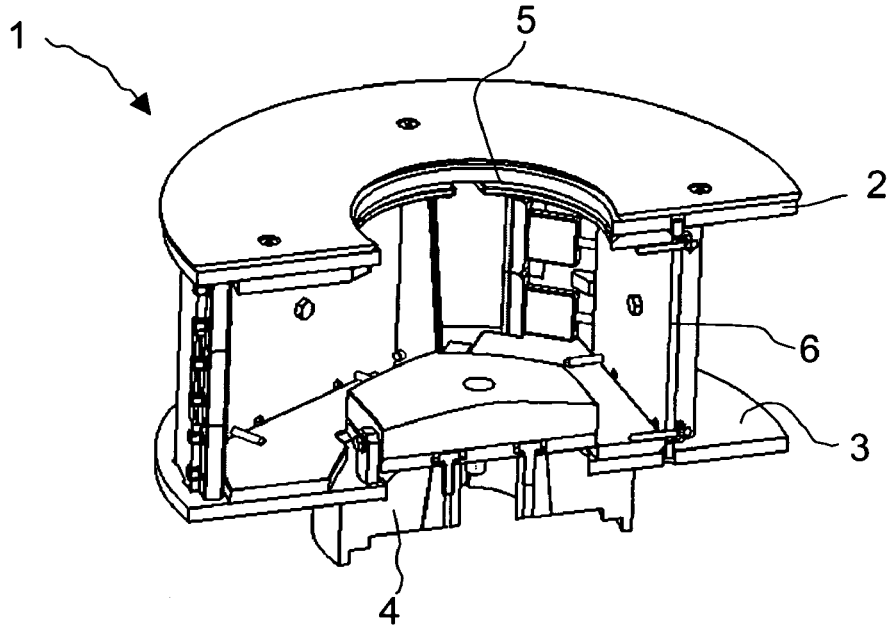
FIG. 1 is three-dimensional section view and shows a rotor for a VSI-crusher
Figure 2:
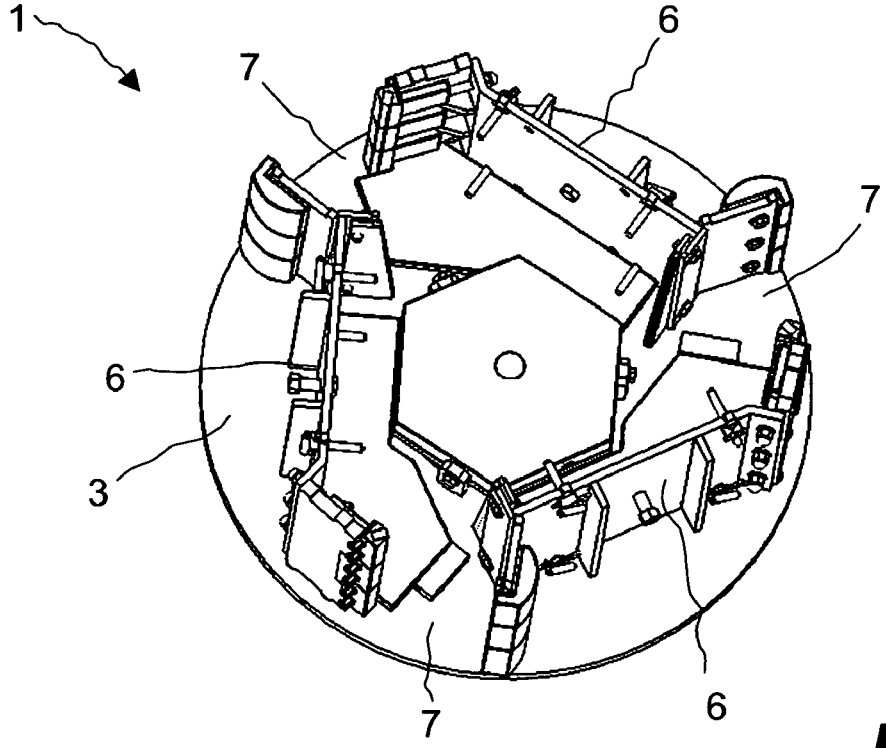
FIG. 2 is a three-dimensional view and shows the rotor of FIG. 1 with the upper disc removed.
Figure 3:
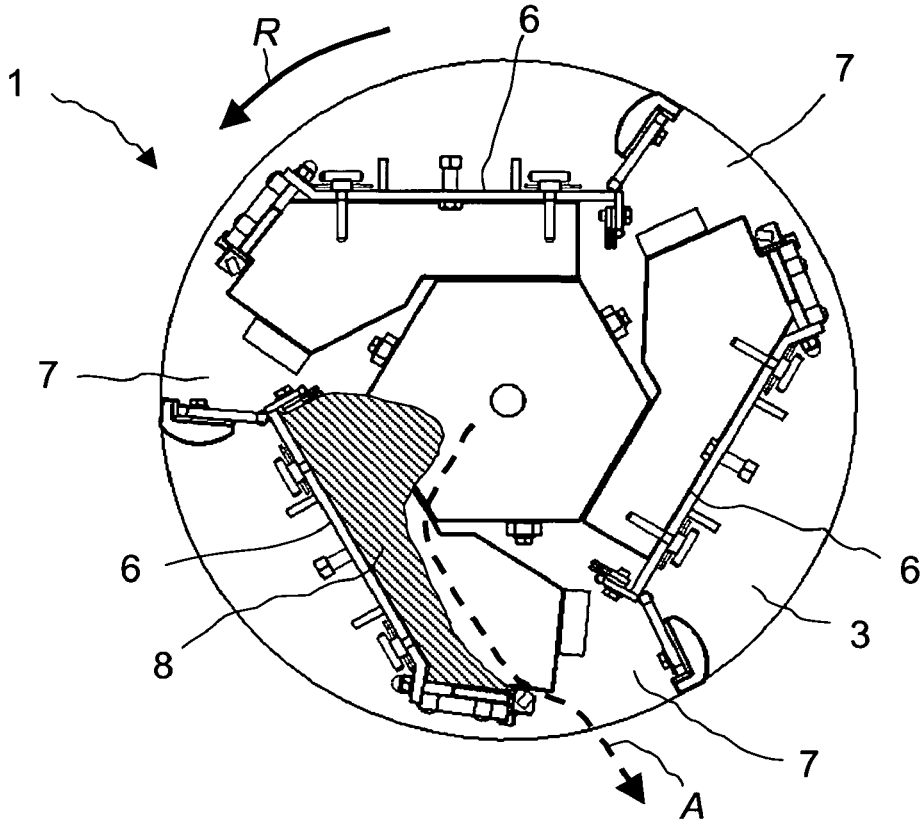
FIG. 3 shows the view of FIG. 2 as seen from above in a two dimensional perspective.

FIGS. 1-3 show a rotor 1 for use in a vertical shaft impact (VSI) crusher. The rotor 1 has a roof in the form of an upper disc 2, and a floor in the form of a lower disc 3. The lower disc 3 has a hub 4, which is welded to the lower disc 3. The hub 4 is to be connected to a shaft (not shown) for rotating the rotor 1 inside the housing of a VSI-crusher.

The upper disc 2 has a central opening 5 through which a first flow of material to be crushed can be fed into the rotor 1.

The upper and lower discs 2, 3 are separated by and held together by a vertical rotor wall which is separated into three wall segments 6. The gaps between the wall segments 6 define outflow openings 7 through which material may be ejected against a housing wall.

During operation of the rotor 1*a* bed 8 of material is built up inside the rotor 1 against each of the three wall segments 6. In FIG. 3 only one single bed 8 of material is shown.

The dashed arrow A describes a typical passage of a piece of rock fed to the rotor 1 via the central opening 5 and ejected via an outflow opening 7. The arrow R indicates the rotational direction of the rotor 1 during operation of the VSI-crusher.

Figure 4:
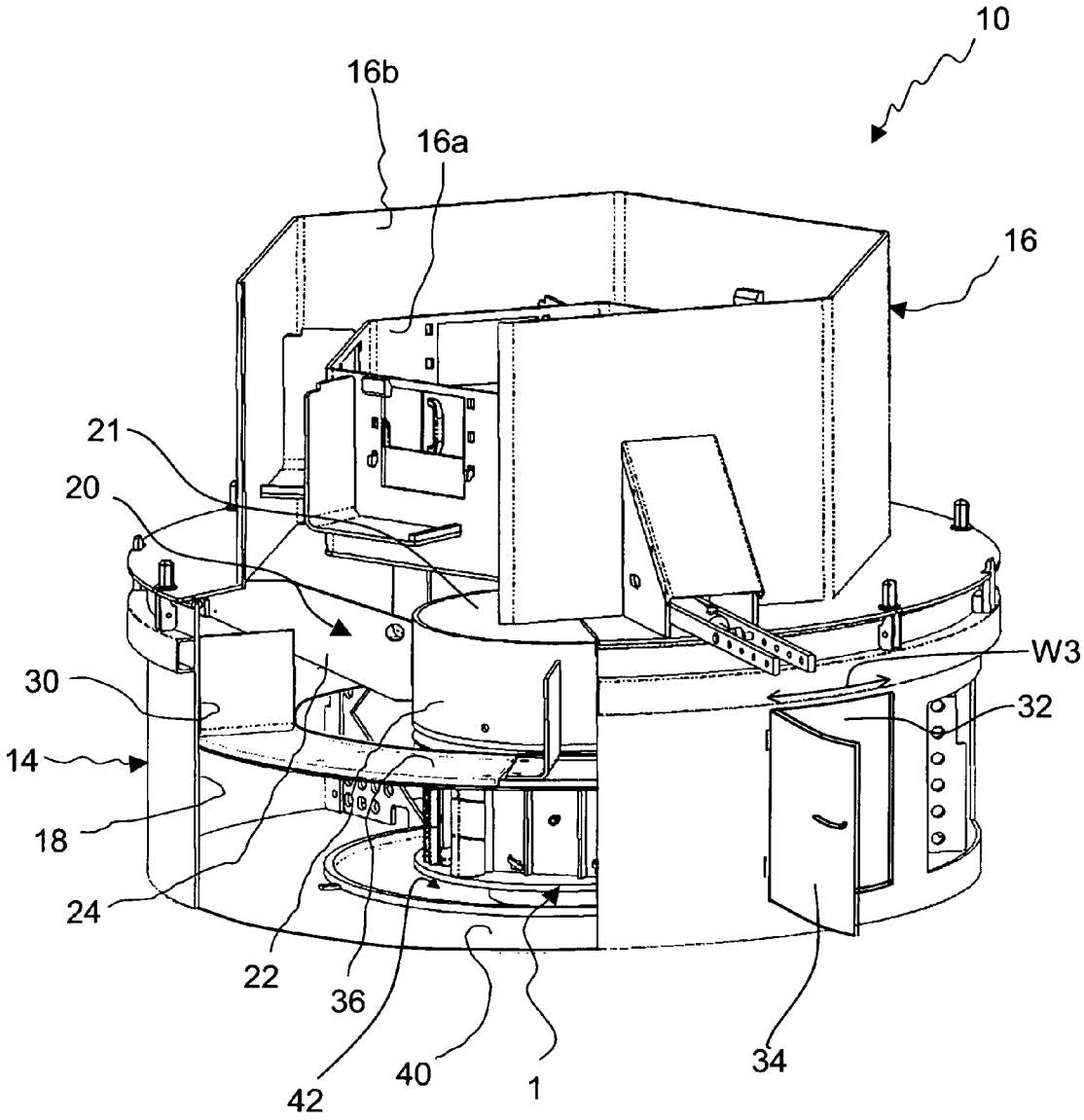
FIG. 4 is a three dimensional view, partly in section, and shows a VSI-crusher.

In FIG. 4 a VSI-crusher 10 is shown, partly in section. The crusher 10 includes the rotor 1, located inside a housing 14. At the top of the crusher 10 a feed hopper 16 is located for feeding the crusher 10 with material to be crushed. The material to be crushed is accelerated by the rotor 1 towards an inner surface of a circumferential impact wall section 18 of the housing 14. In operation a bed of material, not shown in FIG. 4, is built up against the inner surface of the impact wall section 18, and the material accelerated by the rotor 1 will be crushed against that bed of material, in a manner similar to, for example, FIG. 6 of WO 2004/020103.

The feed hopper 16 has a hexagonal inner hopper 16*a* and a hexagonal outer hopper 16*b*, and a space formed between the inner hopper 16*a* and the outer hopper 16*b* is provided with means for creating a second flow of material in line with the teachings of WO 2004/020103.

A feed kit assembly 20 is placed below the inner hopper 16*a*. The feed kit assembly 20 includes a feeding chamber 21 defined by a feeding chamber side wall. In the embodiment shown in the figure, the feeding chamber side wall has the shape of a feeding cylinder 22. The feeding cylinder 22 is fixed to the inside of the housing 14 with the aid of three beams, of which only the beam 24 is shown in FIG. 4.

A circumferential distributing wall section 30, which forms a part of the housing 14, is located at the same level as the feeding cylinder 22, and above the circumferential impact wall section 18. The distributing wall section 30 is provided with a distributing wall aperture 32, having a width W3 and being covered by a distributing wall aperture door 34 for accessing the feed kit assembly 20. In the particular embodiment example shown in FIG. 4, the distributing wall aperture door 34 extends downwards across the impact wall section 18, thereby permitting access also to the rotor 1. A cavity ring 36 separates the distributing wall section 30 from the impact wall section 18.

A bed retention ring 40 is located at the bottom of the crusher 10 for supporting the build up of a bed of material against the impact wall section 18, as mentioned hereinbefore. Crushed material leaves the crusher 10 via a gap 42 formed between the rotor 1 and the bed retention ring 40.

Figure 5:
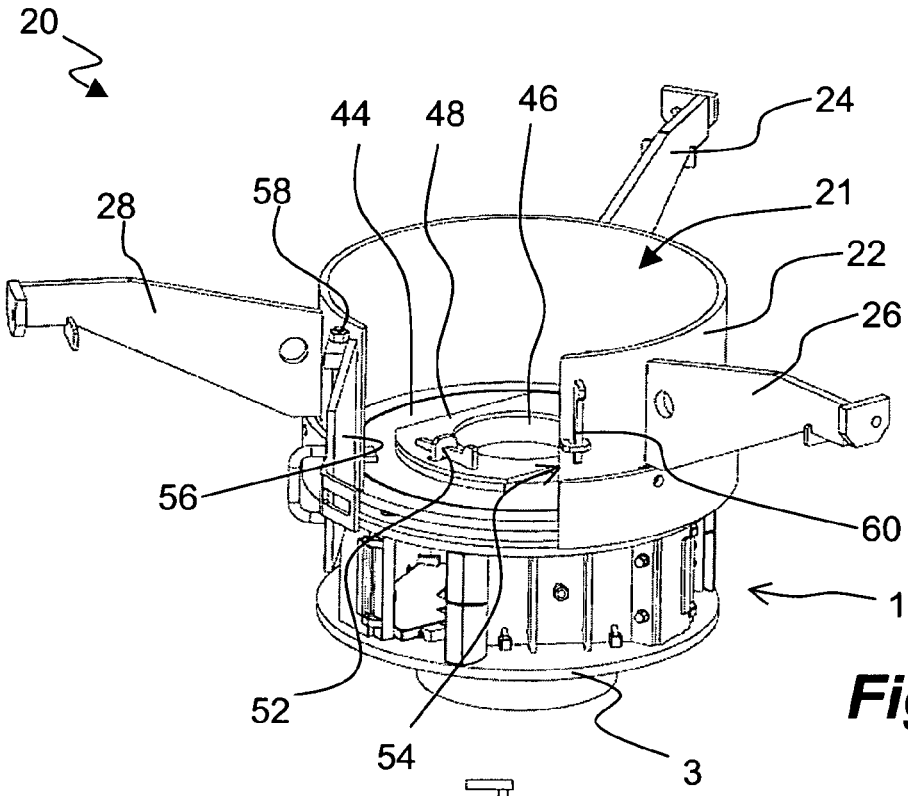
FIG. 5 is a view in perspective of a feed kit assembly and a rotor for a VSI-crusher.
Figure 6:
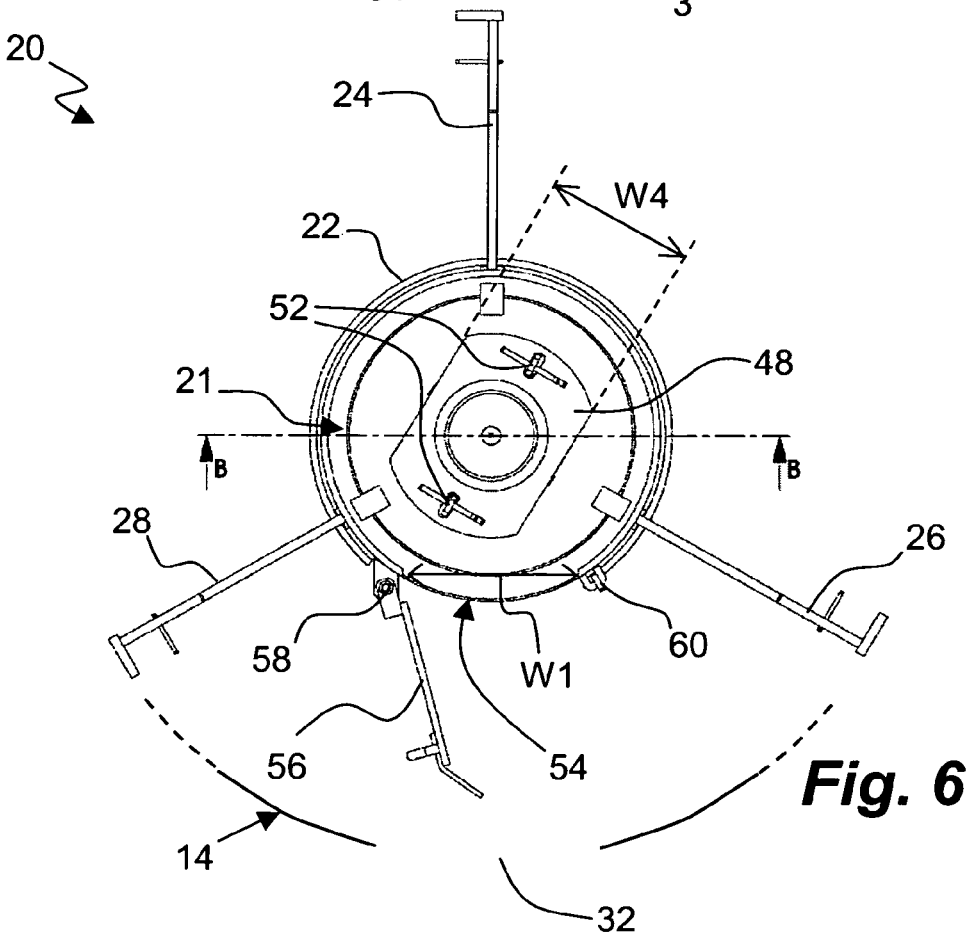
FIG. 6 is a top plan view of the feed kit assembly and rotor of FIG. 5.
Figure 7:
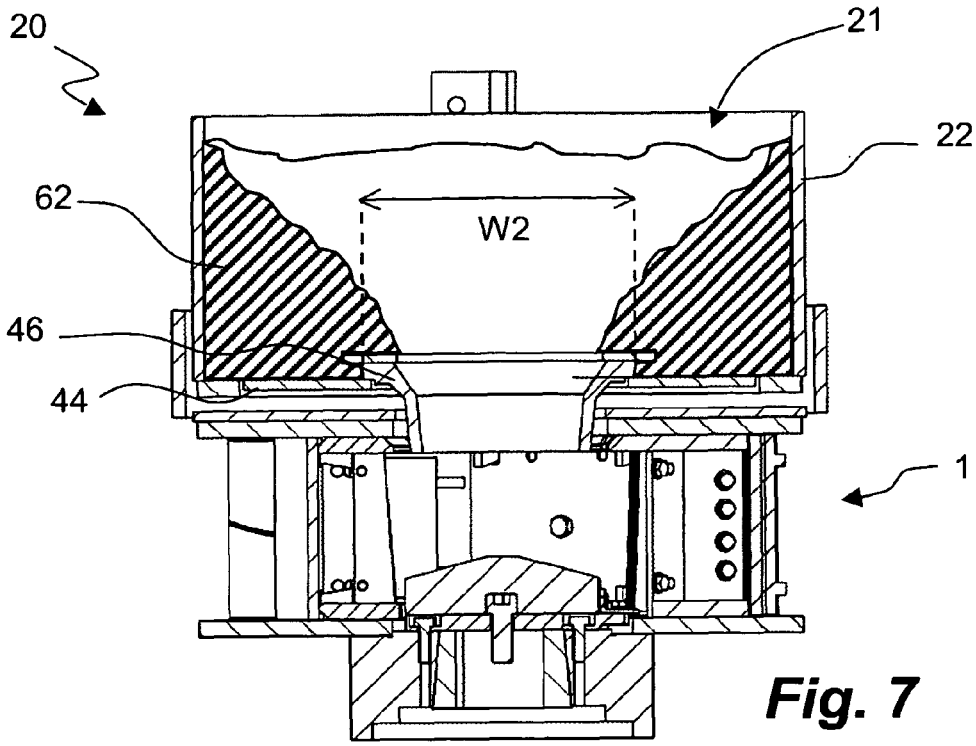
FIG. 7 is a section view, as seen along the line B-B of the feed kit assembly and rotor of FIG. 6.

FIGS. 5-7 show the feed kit assembly 20, together with the rotor 1, in greater detail. The feed kit assembly 20 includes the feeding cylinder 22, which is supported by three beams 24, 26, 28. From the bottom surface of the feeding cylinder 22, which acts as a feed tube holder 44, a feed tube 46 extends downwards into the central opening 5 (shown in FIG. 1) of the rotor 1. The function of the feed tube 46 is to direct the flow of material to be crushed from the feeding cylinder 22 and into the rotor 1. A feed tube retaining plate 48 holds the feed tube 46 against the feed tube holder 44, and the feed tube retaining plate 48 is locked onto the feed tube holder 44 by means of two arrangements 52 of location loops and wedges.

The feeding cylinder 22 is provided with a feeding cylinder aperture 54, which has a width W1 and may be covered by a feeding cylinder aperture door 56. The feeding cylinder aperture door 56 is hung on hinges 58, and may be locked in a closed position using a loop-and-wedge arrangement 60. The width W1 of the aperture 54 is larger than a width W2, illustrated in FIG. 7, of the feed tube 46, such that the feed tube 46 may be removed from the feeding chamber 21 via the aperture 54. The width W1 of the aperture 54 is also larger than a width W4 of the feed tube retaining plate 48, such that the retaining plate 48 may also be removed from the feeding chamber 21 via the aperture 54.

When the crusher 10 is in operation, material to be crushed is supplied from above, and is forwarded from the inner hopper 16*a* into the rotor 1 by the feed kit assembly 20. A bed of retained material 62, illustrated in FIG. 7, protects most of the feeding cylinder 22 and the feed tube holder 44; the highest exposure to wear therefore is on the feed tube 46 and the feed tube retaining plate 48.

Referring again to FIG. 4, the width W3 of the distributing wall aperture 32 is larger than the width W2, illustrated in FIG. 7, of the feed tube 46, and the width W4, illustrated in FIG. 6, of the feed tube retaining plate 48. For ease of access, the distributing wall aperture 32 and the feeding cylinder aperture 54 are, preferably, at least partly aligned with each other, as indicated in FIG. 6, such that an operator may reach through the distributing wall aperture 32 and further through the feeding cylinder aperture 54 when working with feed tube replacement. In case there is not enough space between the feeding cylinder 22 and the distributing wall section 30 for the feeding cylinder door 56 to swing open, the distributing wall aperture 32 may be made wide enough to allow the feeding cylinder aperture door 56 to swing open through the distributing wall aperture 32. Alternatively, the feeding cylinder aperture 54 may, for example, be provided with a sliding door or a double door, requiring less space to open.

Thanks to the apertures 32, 54, the feeding chamber 21, and in particular the feed tube 46 and the feed tube retaining plate 48, may be inspected for wear, and serviced, without removing the hopper 16. Instead, the feed tube 46 may be replaced by opening the distributing wall aperture door 34; opening the feeding cylinder aperture door 56; detaching the feed tube 46 by clearing away any remaining parts of the bed of retained material 62, releasing the location loop-and-wedge arrangements 52, and removing the feed tube retaining plate 48; removing the feed tube 46 via the apertures 54, 32; inserting a new feed tube 46 via the apertures 32, 54; placing the new feed tube 46 in its position in the feed tube holder 44; securing the new feed tube 46 by attaching the feed tube retaining plate 48, and locking it with the location loop-and-wedge arrangements 52; closing the feeding cylinder aperture door 56; and closing the distributing wall aperture door 34.

Figure 8:
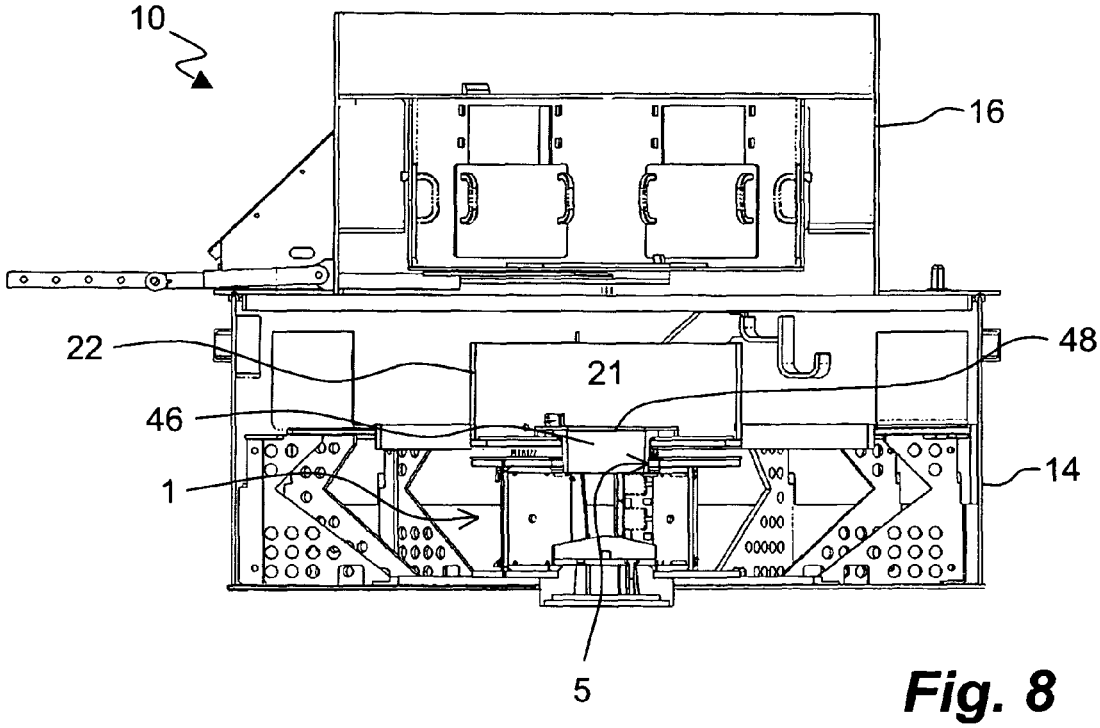
FIG. 8 is a sectional view and shows the crusher of FIG. 4.

The cross-sectional view of FIG. 8 further illustrates the location of the feeding cylinder 22, the feed tube 46, and the feed tube retaining plate 48. As can be seen in the figure, the feed tube 46 extends into the central opening 5 of the rotor 1.

It will be appreciated that numerous modifications of the embodiments described above are possible within the scope of the appended claims.

For example, in an alternative embodiment of the invention, the feeding chamber side wall 22 need not be cylindrical, but may have other geometrical shapes. The side wall may, for example, also be inclined, thereby forming a hopper, or have any other shape.

Furthermore, it is not necessary that the feed tube 46 extends into the central opening 5 of the rotor 1. The feed tube 46 could terminate just above the rotor 1.

Even though the apertures 32, 54 and doors 34, 56 shown in the figures have a rectangular shape, they may in fact have any shape, for example, oval or polygonal shape, enabling performing service to the interior of the feeding chamber 21. Furthermore, it is not necessary that the doors 34, 56 be hung on hinges as shown in the figures. The doors 34, 56 may be any type of lids, covers or hatches that are suitable for closing an aperture. They do not have to be side-hinged as shown in the figures; in fact, they do not need to be hinged at all. For example, the door 56, and the distribution wall aperture door 34 mutatis mutandis, may also be, for example, a sliding door, arranged to slide along a pair of horizontal or vertical guides, or it may be fixed to the side wall 22 solely by using, for example, a plurality of loop-and-wedge arrangements similar to the loop-and-wedge arrangement 60, or even by using nut-and-bolt arrangements.

The feeding chamber side wall aperture 54 shown in the figures extends vertically along the entire cylindrical side wall 22. This is not necessary; also openings that do not extend vertically from edge to edge of the cylindrical side wall may be used.

Above it has been described that the feeding cylinder aperture door 56 is hinged in the actual side wall 22. It will be appreciated that a feeding cylinder aperture door may, as alternative, be attached to some other structure, such as the housing 14 or any of the beams 24, 26, 28, and may still be operative for uncovering and closing the feeding cylinder aperture 54.

The distributing wall aperture door 34 shown in the figures extends downwards across a portion of the impact wall section 18. This is not necessary, but is merely shown as an example of an extra feature, which allows simultaneous access to the rotor 1. The lower boundary of the distributing wall aperture 32, through which aperture the feed tube 46 may be removed, is in fact defined by the cavity ring 36.

The expression "a width" relates not only to an extension in a horizontal direction; the width can also be measured in the vertical or any diagonal direction. It will be appreciated that in some cases it may possible to tilt the feed tube 46 and/or the feed tube retaining plate 48 while moving them out of the feeding cylinder aperture 54. In such a case, the relevant width of the feeding cylinder aperture 54 is often the diagonal of the aperture.

Although described in connection with preferred embodiments thereof, it will be appreciated by those skilled in the art that additions, deletions, modifications, and substitutions not specifically described may be made without departure from the spirit and scope of the invention was defined in the appended claims.

The invention claimed is:

1. A vertical shaft impact crusher comprising:

a rotor that rotates about a substantially vertical axis for accelerating a flow of material to be crushed;

a housing comprising a circumferential impact wall section against which the accelerated flow of material may be crushed;

a feed tube for vertically feeding a flow of material into the rotor to be crushed;

a feeding chamber for vertically feeding a flow of material into the feed tube, wherein the feeding chamber includes a feeding chamber side wall; and a first door for opening and closing a first aperture in the feeding chamber side wall, wherein said feed tube is removable from said feeding chamber via said first aperture.

2. The crusher according to claim 1, wherein said first aperture has a width that is larger than a width of the feed tube.

3. The crusher according to claim 1, wherein the feeding chamber side wall is cylindrical with a circular shape, when viewed along the vertical axis, and the first door has a profile, when viewed along the vertical axis, that is curved along the circular shape of the feeding chamber side wall.

4. The crusher according to claim 1, wherein the feeding chamber side wall has a polygonal shape, when viewed along the vertical axis.

5. The crusher according to claim 1 further comprises a second door for opening and closing a second aperture formed in the housing, wherein the second aperture is at least partially aligned with the first aperture, such that said feed tube may be removed from said feeding chamber via said first aperture and further from the housing via said second aperture.

6. The crusher according to claim 5, wherein said second aperture has a width that is larger than a width of the feed tube.

7. The crusher according to claim 1 further comprises a feed tube retaining plate for holding the feed tube in position above the rotor, wherein the width of the first aperture is larger than a width of the feed tube retaining plate.

8. A method for replacing a worn feed tube of a vertical shaft impact crusher, the crusher comprising a rotor that rotates about a substantially vertical axis for accelerating a flow of material to be crushed; a housing comprising a circumferential impact wall section against which the accelerated flow of material may be crushed; a feed tube for vertically feeding a flow of material into the rotor to be crushed; a feeding chamber for vertically feeding a flow of material into the feed tube, wherein the feeding chamber includes a feeding chamber side wall; and a first door for opening and closing a first aperture in the feeding chamber side wall, comprising the steps of:

uncovering the first aperture in the feeding chamber side wall by operating the first door;

removing the worn feed tube via the first aperture;

installing a new feed tube via the first aperture; and closing the first door.

9. A method according to claim 8, further comprising uncovering, prior to uncovering the first aperture in the feeding chamber side wall, a second aperture in the housing by operating a second door in the housing;

removing the worn feed tube via the first aperture and the second aperture;

inserting the new feed tube via the second aperture and the first aperture; and closing, after closing the first door, the second door.

* * * * *